US005387034A

United States Patent [19]

Bauer et al.

[11] Patent Number: 5,387,034

[45] Date of Patent: Feb. 7, 1995

[54] MIXING DEVICE FOR THE PACKAGING AND DISPENSING OF A MIXTURE OF TWO PRODUCTS ISOLATED FROM EACH OTHER BEFORE THE DISPENSING OPERATION

[75] Inventors: Daniel Bauer, Le Raincy; Gérard Braque, Mitry-le-Neue; Dominique Esclar, Herpy L'Arlesienne, all of France

[73] Assignee: L'Oreal, Paris, France

[21] Appl. No.: 161,544

[22] Filed: Dec. 6, 1993

[30] Foreign Application Priority Data

Dec. 14, 1992 [FR] France ..... 92 15012

[51] Int. Cl.[6] ..... B01F 15/02

[52] U.S. Cl. ..... 366/130; 222/145

[58] Field of Search ..... 366/129, 130, 14, 150, 366/167, 604, 605; 122/129, 130, 145

[56] References Cited

U.S. PATENT DOCUMENTS

| | | | |
|---|---|---|---|
| 4,641,974 | 2/1987 | Church | 366/130 |
| 4,735,509 | 4/1988 | Rausch | 366/129 |
| 4,799,801 | 1/1989 | Bruning | 366/129 |
| 4,988,017 | 1/1991 | Schrader et al. . | |
| 5,114,240 | 5/1992 | Morris | 366/129 |
| 5,193,907 | 3/1993 | Faccioli | 366/130 |
| 5,240,322 | 8/1993 | Haber | 366/130 |

FOREIGN PATENT DOCUMENTS

| | | |
|---|---|---|
| 0063759 | 11/1982 | European Pat. Off. . |
| 0217582 | 4/1987 | European Pat. Off. . |

*Primary Examiner*—Robert W. Jenkins
*Attorney, Agent, or Firm*—Young & Thompson

[57] ABSTRACT

Device for mixing at least two products (11, 21) each contained in a container (10, 20), one of the containers (10), or first container, having a volume suitable to receive the product (21) contained in the other container (20), or second container, in order to obtain the mixture (41) of the two products (11, 21), the first container (10) comprising, in its upper part, a push-button (15) equipped with a nozzle (16) and the actuation of which allows the mixture (41) to leave the first container (10) via the nozzle (16); the two containers (10, 20) are carried by a common casing (30) into which they are fitted so as to slide between two positions, a position called far-apart position for which the two containers (10, 20) are not in communication, and a position called close-together position for which the two containers (10, 20) are in communication, the casing (30) preventing, in the far-apart position, any action on the push-button (15) of the first container (10) and allowing action on the said push-button (15) in the close-together position, communication means (17, 18, 22) which can be closed off being provided between the two containers (10, 20).

9 Claims, 3 Drawing Sheets

MIXING DEVICE FOR THE PACKAGING AND DISPENSING OF A MIXTURE OF TWO PRODUCTS ISOLATED FROM EACH OTHER BEFORE THE DISPENSING OPERATION

The present invention relates to a mixing device for the packaging and dispensing of a mixture of two products isolated from each other before the dispensing operation.

Numerous devices have already been proposed enabling two products, which it is desired to mix just before using, to be packaged separately within the same package.

This is the case, especially, of the mixing bottle described in EP-A2-0,243,730 which includes two compartments arranged axially one after the other, a closure member closing, during storage, the connecting area of the two compartments; the closure member is carried by a plug seal fitted at the end of the bottle so as to rotate by means of a ramp linkage, so that, when the plug seal is rotated with respect to the bottle, the closure member clears the communication between the two compartments and the two products can be mixed; the plug seal carries a pouring lip closed off by a closure element connected to the lip by a divisible area. Such a mixing bottle, in addition to the fact that it is complicated to construct, has the drawback of not having safety of use in that it is possible for the bottle to be used without the two products having been mixed.

The subject of the present invention is a mixing device of simple construction and not having the aforementioned drawback.

Thus, according to the invention, a device for mixing at least two products each contained in a container, one of the containers, or first container, having a volume suitable to receive the product contained in the other container, or second container, in order to obtain the mixture of the two products, the first container comprising, in its upper part, a push-button equipped with a nozzle and the actuation of which allows the mixture to leave the first container via the nozzle, is characterized in that the two containers are carried by a common casing in which they are fitted so as to slide between two positions, a position called far-apart position in which the two containers are not in communication, and a position called close-together position in which the two containers are in communication, the casing preventing, in the far-apart position, any action on the push-button of the first container and allowing action on the said push-button in the close-together position, communication means which can be closed off being provided between the two containers.

Advantageously, the casing has a length such that, in the far-apart position of the two containers, the first container is entirely contained in the casing, including its push-button, whereas the second container extends beyond the casing, while, in the close-together position of the two containers, the push-button of the first container extends beyond the casing and is thereafter accessible from outside the casing.

Preferably, the casing consists of a cylindrical wall closed in its upper part by a cap in which an orifice is made, the cross-section of which is equal, to within a clearance, to the cross-section of the push-button of the first container, the lower part of the casing being provided with a passage at most equal to the cross-section of the second container.

Likewise preferably, a compressible means temporarily keeps the first container away from the cap of the casing during storage, the push-button of the first container being inside the casing.

Advantageously, catch means are provided for immobilizing the assembly in the close-together position of the two containers, the push-button of the first container emerging from the casing, thereby being accessible from outside the casings according to one embodiment, the catch means include a step provided on the second container and in which the rim of the lower part of the casing defining the passage comes to be lodged.

As a variant, the casing has a length such that, irrespective of the position of the two containers, the two containers are contained in the casing which retains, in its lower part, a pusher projecting outside the casing and interacting with the second container.

According to another variant, the casing is made from two elements, an upper element and a lower element, fitted into each other, with the possibility of relative axial displacement of one of the elements in relation to the other, the casing comprising a bottom constituted by the bottom of the lower element, and each of the two elements being located inside one of the elements.

Advantageously, irrespective of the variant, a compressible means is provided in the casing between the two containers.

The means of communication between the two containers are of the manual-pump type; as a variant, the communication means are of the valve type, a pressurized propellent fluid being provided in the second container.

The push-button of the first container actuates a manual pump; as a variant, the push-button operates a valve, the first container being filled with a propellent fluid under a pressure less than the pressure of the propellent fluid present in the second container.

When the assembly is designed for use head up, at least one of the two containers is endowed with a plunger tube.

In order to make the subject of the invention easier to understand, an embodiment represented by the appended drawings will now be described by way of purely illustrative and non-limiting example.

Figure 1:
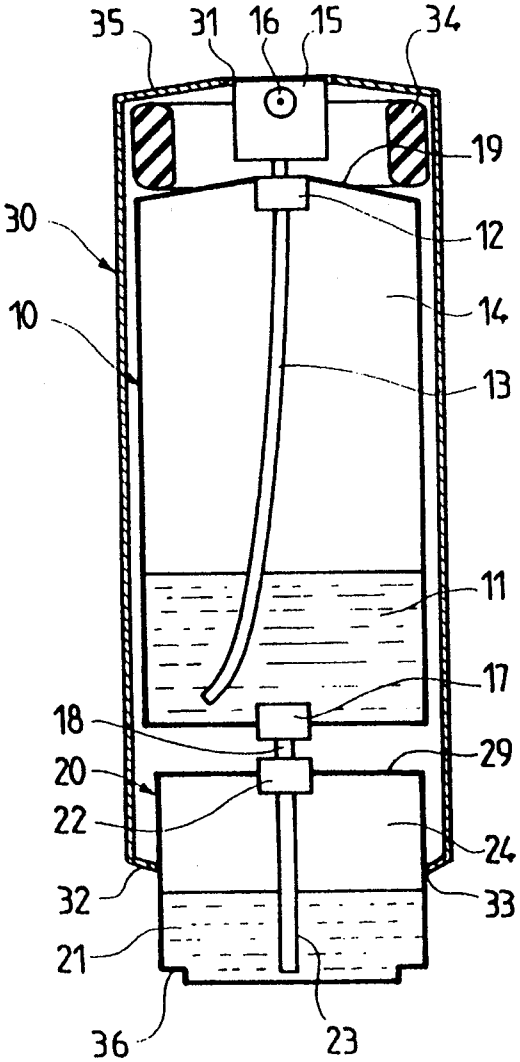
FIG. 1 represents diagrammatically in section a mixing device according to the invention, as it appears during storage, before use.

Referring to FIG. 1, it may be seen that a mixing device, according to the invention, includes two containers: a first container 10, containing a first product 11, and a second container 20, containing a second product 21; the two products 11 and 21 are intended to be mixed just before use: they may be of any kind, such a mixture being able to have as many applications in hair- or body-cosmetics (dyeing, permanent waving, lacquers, sun-screen products, etc) as industrial or technical applications (paints, adhesives, mastics, foams, etc), or medical applications, dermatological applications, household applications, food applications, etc; the mixing may, indeed, give rise to any chemical reaction, whether total, partial or in equilibrium: neutralization, acidification, alkalinization, oxidation, reduction, catalysis, dissolving, fluidizing, putting into suspension, perfuming, colouring, etc.

The first container 10, in the example represented, is a conventional aerosol can, the upper wall 19 of which carries a valve 12 which can be actuated by a push-button 15 fitted with a dispensing nozzle 16; the valve 12 is connected to a plunger tube 13; the volume 14 of the container 10, above the level of the product 11, is occupied by a propellent fluid under pressure.

The second container 20, such as represented, is of the same kind as the container 10: its upper wall 29 carries a valve 22 connected to a plunger tube 23; the volume 24 of the container 20, above the level of the product 21, is occupied by a propellent fluid under a pressure greater than the pressure of the propellent fluid in the volume 14 of the first container 10.

Figure 2:
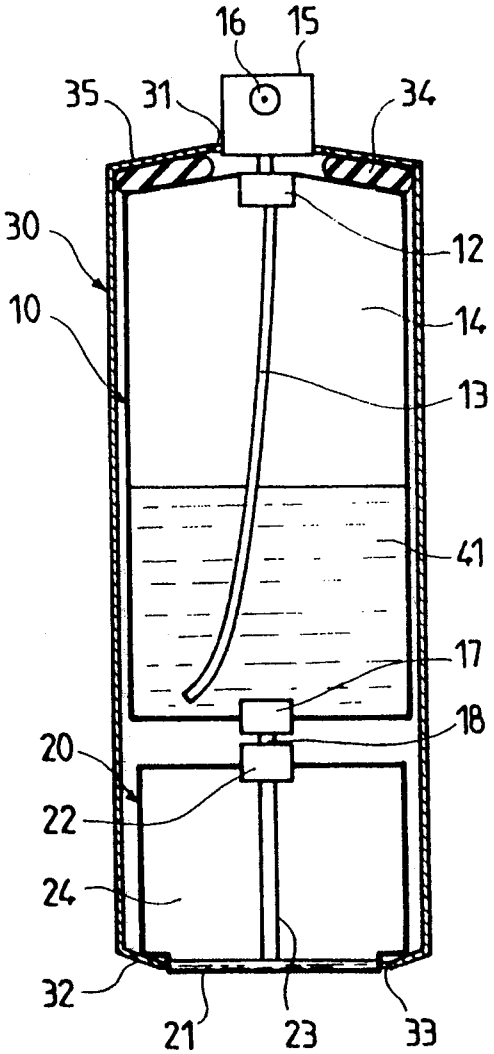
FIG. 2 is similar to FIG. 1, but the mixing device is represented ready for use.

The two containers 10 and 20 are arranged one above the other in a common casing 30; communication means which can be closed off are provided between the two containers 10 and 20: they consist of a control rod 18 of the valve 22 of the second container 20, the said control rod 18, which is tubular as known per se, being carried by a pusher 17, integral with the bottom of the first container 10 and fitted with a channel, not represented, in communication, on the one hand, with the rod 18 and, on the other hand, with the inside of the first container 10; in the relative position of the containers 10 and 20, called the far-apart position, represented in FIG. 1, the valve 22 is closed; when the two containers 10 and 20 are moved closer together, under the conditions described hereinbelow, towards a position called close-together position, such as represented in FIG. 2, the control rod 18 penetrates the valve 22 which it opens, and the product 21 of the second container 20, under the action of the propellent fluid present in this second container 20, rejoins the contents of the first container 10 via the plunger tube 23, the open valve 22, the rod 18 and the channel of the pusher 17, the pressure of the propellent fluid present in the second container 20 being greater than that of the fluid in the first container 10.

The common casing 30 consists of a cylindrical wall closed, in its upper part, by a cap 35; an orifice 31 is provided in the cap 35; the orifice 31 is located, when the assembly is fitted, in line with the push-button 15 of the first container 10, the cross-section of the orifice 31 being equal, to within a fitting clearance, to the cross-section of the push-button 15.

On the opposite side from the cap 35, the casing 30 is provided with a passage 33 for the second container 20; the passage 33 is defined by the rim of the lower part 32 of the casing 33, in the form of a collar, into which the second container 20 is fitted tightly.

A compressible means 34, in the form of a foam ring, is arranged between the cap 35 of the casing 30 and the upper wall 19 of the first container 10, the said compressible means 34 defining the position of the first container 10 in the casing 30 during storage of the assembly; in this position, as may be seen in FIG. 1, the push-button 15 is flush with the cap 35 of the casing 30, so that it is not accessible from outside; in this storage position, the second container 20 is away from the first container 10, the valve 22 being closed, and the second container 20 extends beyond the lower part of the casing 30 which keeps it in this position by the clamping of its collar 32 against the outer wall of the container 20.

In order to use the mixing device according to the present invention, it suffices, while holding the casing 30, to push the second container 20 into the casing 30: this single manoeuvre causes, on the one hand, the two containers 10 and 20 to move closer together, and therefore the valve 22 to open, allowing the second product 21 to enter the first container 10 and causes, on the other hand, the push-button 15 to leave via the orifice 31 of the casing 30, by the sliding of the two containers 10 and 20 in the casing 30; during these operations, the foam ring 34 is compressed; at the end of travel, the rim of the lower part 32 of the casing 30 is elastically retained in a narrowed part of the container 20 defining a step 36 allowing gripping of the casing 30 on the container 20 and the retention of the assembly in the use position, as represented in FIG. 2; thus, the mixture 41 of the two products is formed, and pressing, thereafter possible, on the push-button 15 allows this mixture 41 to be dispensed via the nozzle 16 of the push-button 15.

Thus, safety of use is ensured: it is impossible to actuate the push-button 15 without forming the mixture 41.

In the example represented, the first container 10 is pressurized, and the push-button 15 actuates a valve 12; as a variant, the first container 10 is equipped with a manual pump.

Likewise, the second container 20 may also be equipped with a pump, the means of communication between the two containers being, in this case, able to be actuated by several successive displacements of the two containers 10 and 20, one in relation to the other, after which the means for gripping the second container 20 by the casing 30 are rendered operational.

A foam ring has been used as compressible means 34; this could also be a spring or an irreversibly deformable element.

Figure 3:
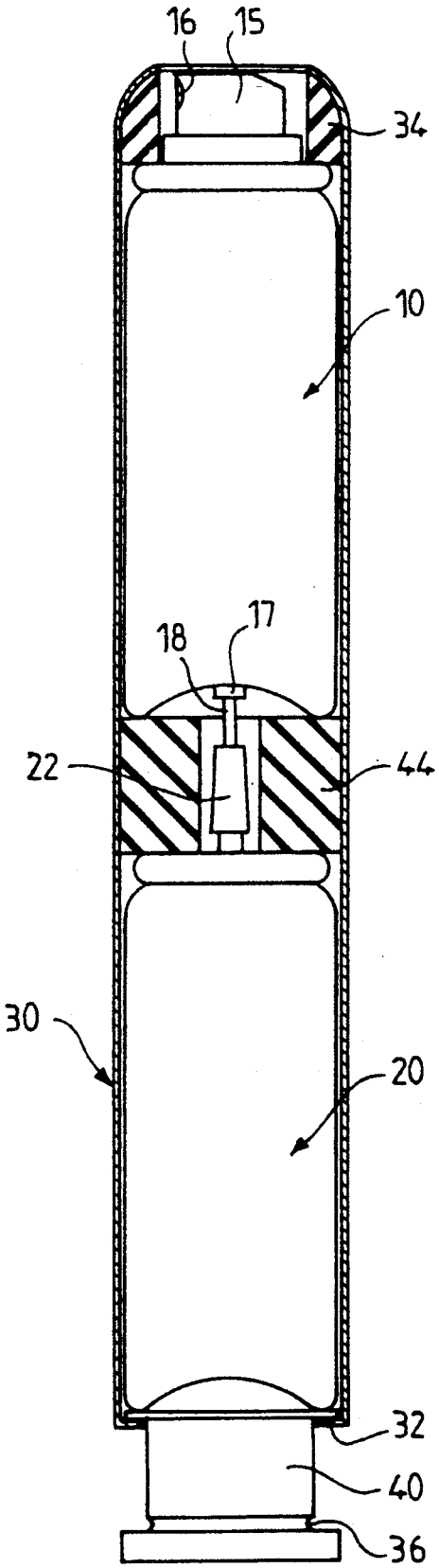
FIG. 3 is a view, partially in section, of a variant of the mixing device according to the invention, as it appears during storage, before use.

According to the variant represented in FIG. 3, when the two containers 10 and 20 are in the far-apart position, the container 20 is contained entirely in the casing 30, the lower part 32 of which retains a pusher 40 projecting outside the casing and interacting with the container 20; in this variant, it is the pusher 40 which carries the latching means 36, here in the form of a groove, in which means the rim of the lower part 32 of the casing 30 comes to be lodged.

Figure 4:
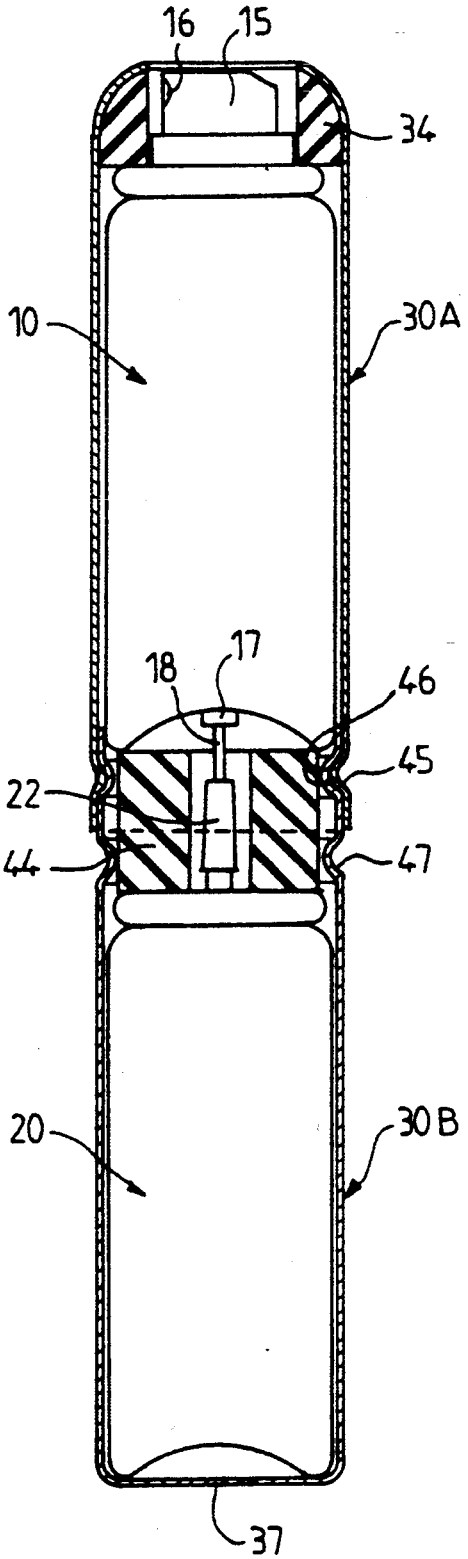
FIG. 4 is similar to FIG. 3, but relates to another variant of the mixing device according to the invention, in which the casing is made from two elements.
Figure 5:
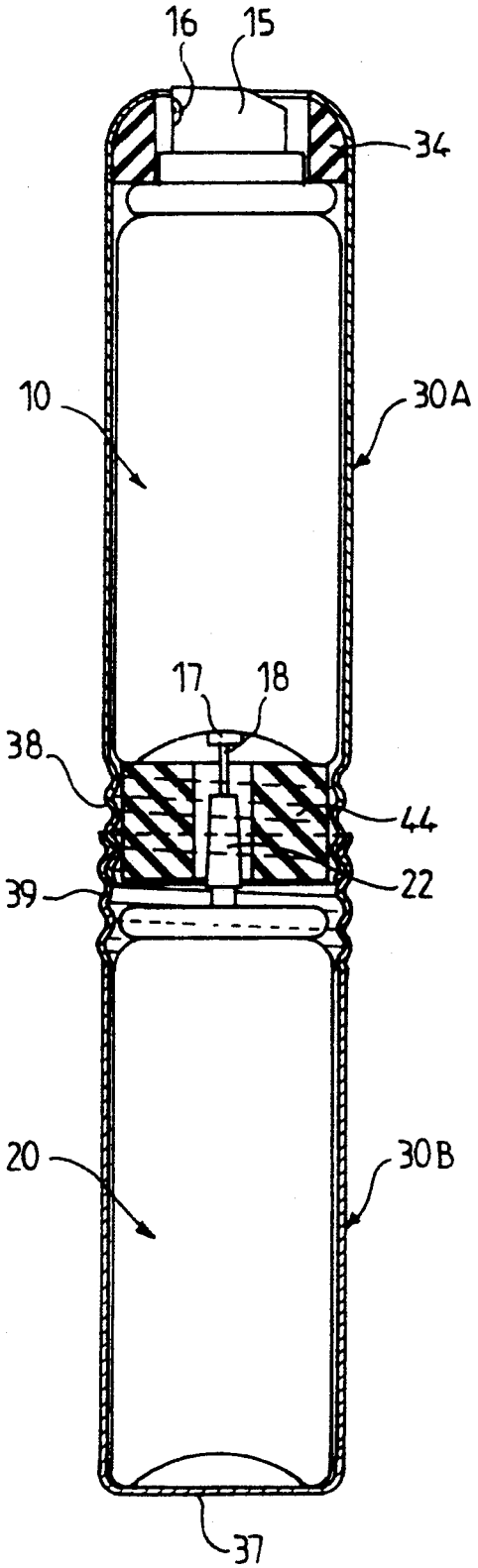
FIG. 5 is similar to FIG. 4, but relates to another variant.
Figure 6:
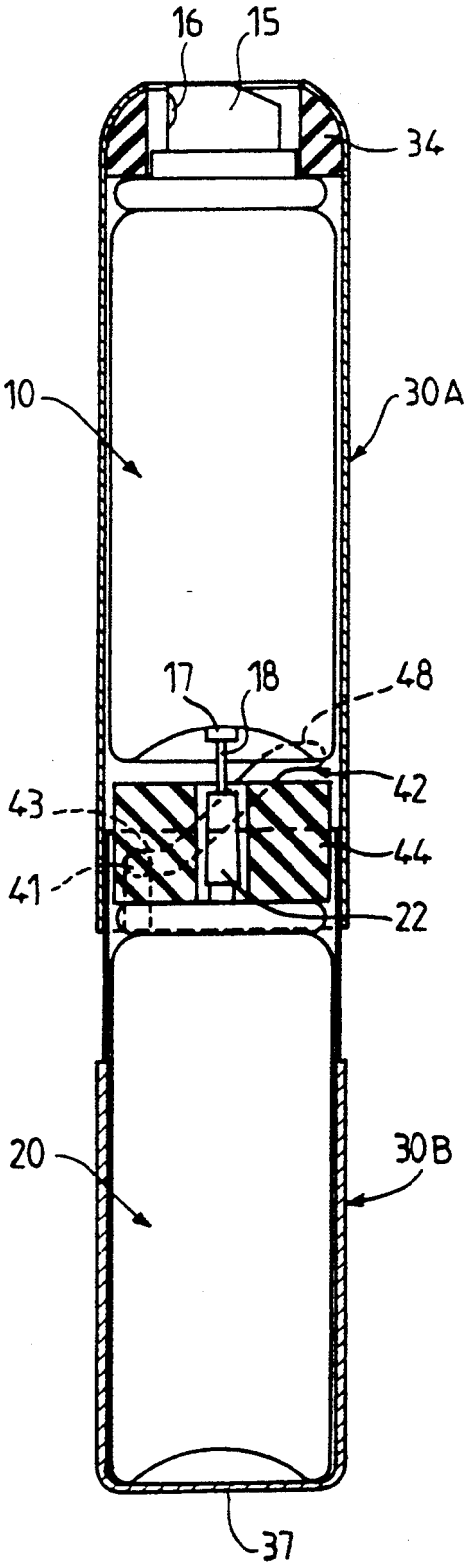
FIG. 6 is similar to FIG. 4, but relates to yet another variant.

According to the variants represented in FIGS. 4 to 6, the casing 30 is made from two elements 30A, 30B, an upper element 30A and a lower element 30B, fitted into each other with the possibility of relative axial displacement of one of the elements in relation to the other element; according to these variants, the casing comprises a bottom 37 constituted by the bottom of the lower element 30B and each of the two containers 10, 20 is located inside each of the elements 30A, 30B; the relative axial displacement of the two elements may be obtained by relative axial sliding and/or by relative rotation.

When the displacement is obtained by sliding, the two elements 30A, 30B, as shown in FIG. 4, are configured so as to ensure the two special relative positions of one in relation to the other, corresponding to the positions called far-apart and close-together positions of the two containers 10, 20; these special positions are, for example, ensured by a groove 45 provided on one of the elements, the upper element 30A, which interacts with two axially spaced-apart grooves 46, 47 provided on the other element, the lower element 30B.

When the displacement is obtained by rotation, one of the elements, the element 30A as shown in FIG. 5, has a helical thread 38 which interacts with a likewise helical thread 39 exhibited by the other element 30B; it is also possible to obtain such a displacement by endowing one of the elements, the element 30B as shown in FIG. 6, with at least one pin or index 41 interacting with an opening in the form of a ramp 42 made in the wall of the other element 30A, the same ramp 42 essentially extending by making a certain angle with the axis of the casing 30A–30B but terminating, at each of its ends, in a small portion 43, 48 located in a plane perpendicular to the axis of the casing, this arrangement enabling the two relative extreme positions of one of the elements of the casing to be locked in relation to the other; according to this variant, the angle of the ramp 42 with the axis of the casing 30A–30B may be provided such that, when the pin or index 41 interacts with this inclined part of the ramp 42, axial stressing of an element 30B in relation to the other element 30A automatically leads to a relative rotation of the two elements 30A, 30B, which facilitates the manoeuvre for bringing the two containers 10 and 20 into communication; thereafter, it suffices to give the two elements 30A, 30B a slight relative rotational movement in order to lock the position of the two communicating containers 10 and 20.

Whatever the variant, advantageously a compressible means, such as, for example a foam ring 44 similar to the ring 34, is provided in the casing 30 between the two containers 10, 20.

We claim:

1. A device for mixing a first product (11) and a second product (21) and for dispensing a mixture (41) of the two products (11, 21), the device comprising a casing (30) and in the casing a first container (10) containing said first product (11) and a second container (20) containing said second product (21), a push-button (15) and a nozzle (16) on a side of said first container (10) opposite said second container (20), actuation of said push-button (15) permitting said mixture (41) to leave said device through said nozzle (16), the two containers (10, 20) being axially slidable in and relative to the casing and relative to each other from a first position in which said containers are spaced apart a first distance and said push-button and nozzle are retracted within said casing and said containers are out of communication with each other, and a second position in which said push-button and nozzle extend out of said casing and are accessible to a user of the device and said first and second containers are spaced apart a second distance less than said first distance, and means responsive to movement of said containers from said first position to said second position to establish communication between said first and second containers whereby the contents of said second container can enter said first container and mix with the contents of the first container to produce said mixture and said mixture can then be dispensed through said nozzle upon operation of said push-button.

2. A device as claimed in claim 1, wherein, in said first position, said second container protrudes from said casing a greater distance than in said second position.

3. A device according to claim 2, and resilient means (32) on said casing which engage behind a portion of said second container in said second position thereby to retain said second container within said casing in said second position.

4. A device according to claim 1, there being a valve between said first and second containers that is closed in said first position, movement of said containers toward each other into said second position opening said valve to establish communication between said first and second containers.

5. A device according to claim 1, and resilient means within said casing resisting movement of said first container toward said second position.

6. A device according to claim 1, and resilient means within said casing between said first and second containers resisting movement of said second container toward said first container upon movement of said first and second containers toward said second position.

7. A device according to claim 1, there being a propellent fluid under pressure in said second container to force said second product from said second container into said first container.

8. A device according to claim 1, and a pusher (40) protruding from an end of said casing opposite said push-button and being adapted to be pressed to move said containers from said first position to said second position.

9. A device according to claim 1, said casing being in two parts that are movable toward and away from each other in said axial direction, movement of said two parts toward each other being effective to move said containers from said first to said second position.

* * * * *